US006702668B2

(12) United States Patent
Banyai

(10) Patent No.: US 6,702,668 B2
(45) Date of Patent: Mar. 9, 2004

(54) MATCH NUMBER GAME

(76) Inventor: Frank B. Banyai, 3132 Waterview Dr., Las Vegas, NV (US) 89117

( * ) Notice: Subject to any disclaimer, the term of this patent is extended or adjusted under 35 U.S.C. 154(b) by 0 days.

(21) Appl. No.: 09/771,148

(22) Filed: Jan. 24, 2001

(65) Prior Publication Data

US 2001/0034262 A1 Oct. 25, 2001

Related U.S. Application Data

(60) Provisional application No. 60/182,762, filed on Feb. 16, 2000.

(51) Int. Cl.[7] ..... A63F 1/00

(52) U.S. Cl. ..... 463/17; 273/274; 273/292

(58) Field of Search ..... 273/292, 274, 273/273, 269; 463/17, 18–19

(56) References Cited

U.S. PATENT DOCUMENTS

| | | | |
|---|---|---|---|
| 4,254,404 | A | 3/1981 | White |
| 4,364,567 | A | 12/1982 | Goott |
| 4,441,714 | A | 4/1984 | Goott |
| 4,467,424 | A | 8/1984 | Hedges et al. |
| 4,494,197 | A | 1/1985 | Troy et al. |
| 4,577,869 | A | 3/1986 | Brinkman |
| 4,635,938 | A | 1/1987 | Gray |
| 4,652,998 | A | 3/1987 | Koza et al. |
| 4,689,742 | A | 8/1987 | Troy et al. |
| 4,756,531 | A | 7/1988 | DiRe et al. |
| 4,842,278 | A | 6/1989 | Markowicz |
| 4,856,787 | A | 8/1989 | Itkis |
| 4,861,041 | A | 8/1989 | Jones et al. |
| 5,005,840 | A | 4/1991 | Schwartz |
| 5,022,653 | A | 6/1991 | Suttle et al. |
| 5,042,809 | A | 8/1991 | Richardson |
| 5,088,737 | A | 2/1992 | Frank et al. |
| 5,265,874 | A | 11/1993 | Dickinson et al. |
| 5,265,877 | A | 11/1993 | Boylan et al. |

(List continued on next page.)

OTHER PUBLICATIONS

Scarne's complete guide "horse race keno".*

"B&O" Bingo.*

Scarne, John "Race Horse Keno" in Scarne's Complete Guide to Gambling, 1961, pp. 432–436, Simon and Shuster, N.Y.

"Bullet Express", San Manuel Indian Bingo & Casino, Highland, CA (Brochure), date prior to Nov. 1995.

"B&O Bingo Game", San Manuel Indian Bingo & Casino, Highland, CA (Brochure), date prior to Nov. 1995.

"Lucky 8 Numbers Bingo", Santa Ynez Indian bingo, Santa Ynez, CA (card with instructions), date prior to Nov. 1995.

"You Pick'em Bingo", Santa Ynez Chumash Casino, Santa Ynez, CA (card with instructions), date prior to Nov. 1995.

"Pai Gow", Commerce Casino, Commerce, CA (brochure), date prior to Nov. 1995.

(List continued on next page.)

*Primary Examiner*—Vishu K Mendiratta
(74) *Attorney, Agent, or Firm*—David Weiss

(57) ABSTRACT

A match number game for being played by a single player or by a plurality of players, preferably at video terminals. In one of its preferred embodiments, the method of the game comprises the steps of: (a) each player placing a wager to a game pool and wager to a progressive pool; (b) assigning to each player a first plurality of designations from a set of designations; (c) randomly drawing a first plurality of designations from the set of designations; (d) paying a prize from the progressive pool to each player whose assigned first plurality of designations match the first plurality of designations drawn in step (c); (e) if no player's assigned first plurality of designations match the first plurality of designations drawn in step (c), continuing randomly drawing designations from such set of designations until a second plurality of designations fewer than the designations in such set are drawn; and (f) paying a prize from the game pool to each player whose assigned first plurality of designations match designations drawn in steps (c) and (e).

38 Claims, 2 Drawing Sheets

U.S. PATENT DOCUMENTS

| | | | | |
|---|---|---|---|---|
| 5,269,523 | A | | 12/1993 | Boylan et al. |
| 5,275,415 | A | | 1/1994 | Wisted |
| 5,276,312 | A | | 1/1994 | McCarthy |
| 5,324,035 | A | | 6/1994 | Morris et al. |
| 5,326,104 | A | | 7/1994 | Pease et al. |
| 5,360,214 | A | | 11/1994 | Harmen |
| 5,377,973 | A | | 1/1995 | Jones et al. |
| 5,380,007 | A | | 1/1995 | Travis et al. |
| 5,398,932 | A | | 3/1995 | Eberhardt et al. |
| 5,401,024 | A | | 3/1995 | Simmunek |
| 5,417,424 | A | | 5/1995 | Snowden et al. |
| 5,429,361 | A | | 7/1995 | Raven et al. |
| 5,494,293 | A | | 2/1996 | Goldfarb |
| 5,505,449 | A | | 4/1996 | Eberhardt et al. |
| 5,536,016 | A | * | 7/1996 | Thompson |
| 5,584,485 | A | | 12/1996 | Jones et al. |
| 5,605,504 | A | | 2/1997 | Huang |
| 5,639,088 | A | | 6/1997 | Schneider et al. |
| 5,674,128 | A | | 10/1997 | Holch et al. |
| 5,679,077 | A | | 10/1997 | Pocock et al. |
| 5,700,009 | A | | 12/1997 | Meoni |
| 5,709,603 | A | | 1/1998 | Kaye |
| 5,722,890 | A | | 3/1998 | Libby et al. |
| 5,727,786 | A | * | 3/1998 | Weingardt |
| 5,779,545 | A | | 7/1998 | Berg et al. |
| 5,810,664 | A | | 9/1998 | Clapper, Jr. |
| 5,823,534 | A | | 10/1998 | Banyai |
| 5,830,063 | A | | 11/1998 | Byrne |
| 6,168,521 | B1 | | 1/2001 | Luciano et al. |
| 6,179,711 | B1 | * | 1/2001 | Yoseloff |
| 2001/0046891 | A1 | * | 11/2001 | Acres |

OTHER PUBLICATIONS

"Chinese Poker", Commerce Casino, Commerce, CA (brochure), date prior to Nov.1995.

"Asian Games Rule Book", Commerce Casino, Commerce, CA (brochure), date prior to Nov. 1995.

"California Baccarat", Commerce Casino, Commerce, CA (brochure), date prior to Nov. 1995.

"Wisted's California Blackjack", Commerce Casino, Commerce, CA (brochure), 1992.

* cited by examiner

MATCH NUMBER GAME

CROSS REFERENCE TO RELATED APPLICATION

This application claims the benefit of U.S. Provisional Application No. 60/182,762, filed Feb. 16, 2000, and the disclosure of said provisional application is incorporated herein by reference.

BACKGROUND OF THE INVENTION

This invention relates to match number gaming methods and apparatus, and more particularly to a match number game that may be played by a plurality of players simultaneously or that may be played by an individual player.

Various types of match number games have been employed for casino use, such as the well-known games of bingo and keno. In recent years, such match number games have been implemented with electronic player stations such as video terminals. The terminals may be networked and the system configured for including a plurality of players in a single game, or the terminal may be configured for play by a single person.

SUMMARY OF THE INVENTION

The gaming system of the present invention, which is similar to keno or bingo but with significant departures therefrom for enhanced excitement, is particularly adaptable for casino play and is preferably electronically implemented as with video terminals, although it may be played without the use of such terminals.

According to one embodiment of the present invention, there is provided a method of playing a game by a player comprising the steps of:

(a) the player placing a wager (preferably to a game pool in addition to placing a wager to a progressive pool);

(b) assigning to the player a first plurality of designations (preferably numbers) from a set of designations (preferably numbers);

(c) randomly drawing a first plurality of designations from such set;

(d) paying a prize (preferably from the progressive pool) to the player if the player's assigned first plurality of designations match the first plurality of designations drawn in step (c);

(e) if the player's assigned first plurality of designations do not match the first plurality of designations drawn in step (c), continue randomly drawing designations from such set until the player's assigned first plurality of designations match designations drawn in steps (c) and (e), or until a second plurality of designations fewer than all designations in such set are drawn from such set, whichever occurs first; and (f) paying a prize (preferably from the game pool) to the player if the player's assigned first plurality of designations match designations drawn in steps (c) and (e).

In step (b), the player preferably selects the first plurality of designations to be assigned to him from the set of designations. In step (d), a further prize may be paid from the progressive pool if a third plurality of the assigned designations match designations drawn from the set, the third plurality being less than the first plurality. In step (f), the amount of the prize is related to the quantity of designations drawn for matching the player's first plurality of designations.

In a preferred aspect of the game, the method includes a wild designation for being randomly drawn as if a designation or number in the set, and when the wild designation is drawn the player may deem one of his assigned designations or numbers to have been drawn.

The placing of a wager to the progressive pool in step (c) may be optional to the player; if the player elects not to place a progressive pool wager, a prize from the progressive pool would not be paid in step (d) but a prize may instead be paid from the game pool.

The preferred embodiments of the present invention include a progressive pool from which certain prizes are paid, and a game pool from which certain other prizes are paid. In the progressive pool, player stations are generally linked to receive progressive wagers from the various player stations into a common pool and unwon prize amounts in each game are carried over to the next game. Gaming systems with progressive pools are well known and prizes paid from such progressive pools are often referred to as "progressive jackpots". Progressive jackpots and systems are described in U.S. Pat. No. 5,536,016 to David J. Thompson, and U.S. Pat. Nos. 5,377,973 and 5,584,485 to Daniel A. Jones et al., the disclosures of each of which patents are incorporated herein by reference.

According to a another preferred embodiment of the invention, there is provided a method of playing a game by a plurality of players comprising the steps of:

(a) each player placing a wager to a game pool and, preferably at each player's option, placing a wager to a progressive pool;

(b) assigning to each player a first plurality of designations (preferably numbers) from a set of designations (preferably numbers);

(c) randomly drawing a first plurality of designations from such set of designations;

(d) paying a prize from the progressive pool to each player whose assigned first plurality of designations match the first plurality of designations drawn in step (c) provided he or she had placed a wager to the progressive pool, and a further prize may be paid from the game pool to each player whose assigned first plurality of designations match the first plurality of designations drawn in step (c);

(e) if no player's assigned first plurality of designations match the first plurality of designations drawn in step (c), continuing randomly drawing designations from such set of designations until a second plurality of designations fewer than all designations in such set are drawn; and (f) paying a prize from the game pool to each player whose assigned first plurality of designations match designations drawn in steps (c) and (e).

The game may end at this point, and any amounts remaining in the game pool may be added to the game pool of the next game. Alternatively, however, the game may continue with the further steps of:

(g) if no player's assigned first plurality of designations match designations drawn in steps (c) and (e), continuing randomly drawing designations from the set of designations until a player's assigned first plurality of designations match designations drawn in steps (c), (e) and (g), or until all the designations in the set have been drawn, whichever occurs first; and (h) if a player's first plurality of designations match designations drawn in steps (c), (e) and (g), paying a prize to such player.

The prize referred to in step (h) may be from the game pool; if such prize has not been won, or if there are any amounts remaining in the game pool for any other reason, such remaining amounts may be carried over to the game pool of the next game for paying this prize, so that the prize eventually paid in step (h) will be progressively increased until won. In step (f), the amount of each prize is related to the quantity of designations drawn for matching a player's assigned first plurality of designations.

BRIEF DESCRIPTION OF THE DRAWINGS

The novel features that are believed to be characteristic of the invention, together with further advantages thereof, will be better understood from the following description considered in connection with the accompanying drawings in which preferred embodiments of the present invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
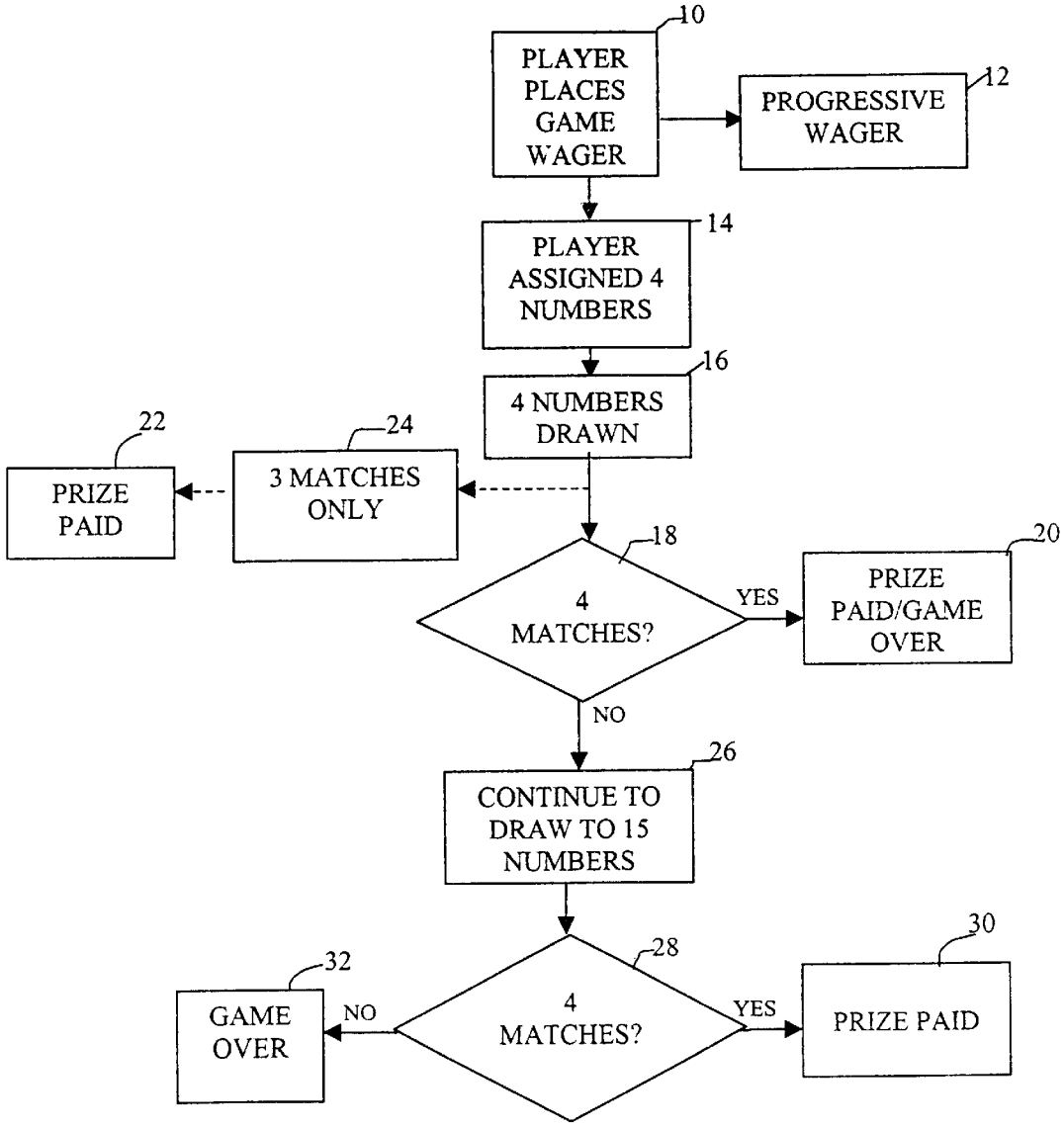
FIG. 1 is a flow chart illustrating a preferred embodiment of the method of playing the match number game of the present invention.
Figure 2:
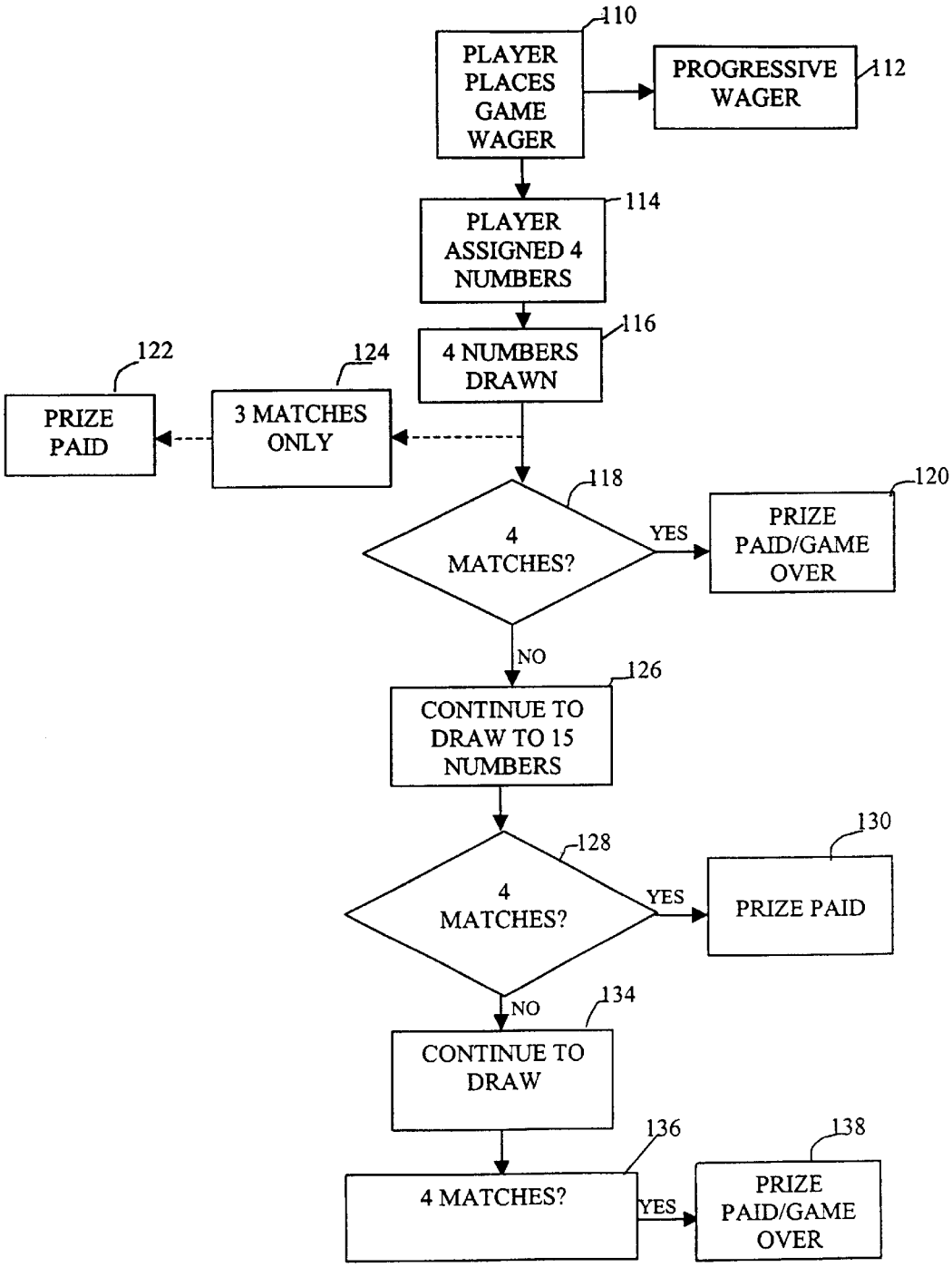
FIG. 2 is a flow chart illustrating a second preferred embodiment of the method of playing the match number game of the present invention.

With respect to either of the two preferred embodiments of the game schematically illustrated in FIGS. 1 and 2, the game is preferably played at electronic player stations such as video terminals including devices for the player to enter his or her wagers and designations, the terminals further including a video display for displaying information including the player designations, the randomly drawn designations and the prizes offered and won. In the individual player embodiment of FIG. 1, each player terminal may include its own random designation or number generator, and the player terminals are linked or networked for implementing the requirements of the progressive pool and game pool, using techniques and apparatus well known in the art. In the multiple player embodiment of FIG. 2, a single random designation or number generator is utilized, such as a ball blower typically used in the gaming industry for bingo, keno and other match number games (for example, ball blowers available from Tripp Enterprises, Inc. of Sparks, Nev., such as its Auto Keno model), and the player terminals and random number generator are networked with a central computer and server for implementing the management of and accounting for the game including the requirements of the progressive pool and the game pool, using techniques and apparatus well known in the art. A gaming system including a plurality of player video terminals and central computer control apparatus is described in U.S. Pat. No. 5,674,128 to Niels C. Holch et al., the disclosure of which patent is incorporated herein by reference.

In the game examples illustrated in FIGS. 1 and 2, the game is played with a set of numbers (say twenty-five numbers in the set from 1 through 25) and a wild designation, and each player at a player terminal is assigned a first plurality (say four) numbers from the set of twenty-five numbers. The player may assign the four numbers himself (i.e., he may select four numbers from the set of twenty-five numbers), or the player may select a conventional "quick-pick" feature on his terminal whereby four numbers are randomly selected by the game system and assigned to him. Of course, other number combinations are possible, as examples three assigned numbers from a set of twenty numbers, four assigned numbers from a set of thirty-nine numbers, or five assigned numbers from a set of forty-nine numbers, plus in each case the wild designation.

Turning to the game flow chart of FIG. 1, a player at a player terminal places a wager to the game pool (block 10) and, at the player's option, he or she may place a wager to the progressive pool (block 12). The wagers may be placed and received by the player terminal by utilization of devices and processes well known in the gaming art, including such devices for receiving and accounting for coins, cash bills, debit cards, credit cards and "smart" cards. Alternatively, the placing of the wager to the progressive pool may be mandatory rather than optional, and in any event a single cash, debit or credit entry may be made by the player with the terminal apportioning the amount entered to the game pool and to the progressive pool.

Each terminal is preferably capable of permitting the player to play one or more "cards" during each game, each card having four numbers assigned thereto as may be selected by the player or by the quick-pick feature, with each of the several (for example, four) cards being displayed on the terminal's video display. The cards are played simultaneously, i.e. the numbers on each card are available for being matched by the numbers drawn by the random number generator; the end of the game with respect to one of the cards does not affect the random number generator's further drawing of numbers for continuing the game with respect to the remaining cards of the player.

Continuing with the game of FIG. 1, the player is assigned four numbers to each card being played by the player from the set of twenty-five numbers (block 14), either by selecting the assigned numbers or by actuating the terminal's quick-pick function. The terminal's random number generator, which contains the twenty-five numbers (from 1 through 25) and preferably a wild designation, randomly draws four numbers (block 16). These four drawn numbers are compared with the four numbers assigned to each of the player's cards to determine whether the four numbers on any player card match the four numbers drawn by the random number generator (block 18). If four matches occur, a prize is paid to the player from the progressive pool (block 20). The prize is normally a pari-mutuel payoff representing a large predetermined percentage of the progressive pool, and may be referred to as the progressive jackpot. The four matches of the first four numbers drawn may be with or without the assistance of the wild designation. In one manner of allotting prizes for four matches out of the first four numbers drawn, the greatest jackpot may be paid to four assigned numbers matched, in numerical order, out of the first four numbers drawn from the set of twenty-five numbers; a second smaller jackpot may be paid to four matches, in any order, out of the first four numbers drawn; and a third yet smaller jackpot may be paid to four matches out of the first four designations drawn where three of the designations are numbers from the set of twenty-five numbers and one of the four drawn designations is the wild designation. A fourth and smallest prize from the progressive pool (block 22) may be paid at this point, if one of the player's cards includes three numbers only (i.e. three but not all four assigned numbers) matching three of the four drawn numbers whether or not including the wild designation (block 24).

With respect to any of the player's cards containing four assigned numbers that have been matched by the first four numbers drawn, the game is over at this point. With respect to any cards in which four matches have not occurred, the game continues. The terminal's random number generator continues the random drawing from the set until a second plurality of designations—say a total of fifteen numbers, including the wild designation if not yet drawn (block 26). With respect to each remaining card of the player, such drawing of numbers continues until the player's assigned four numbers for that card match the numbers drawn, or until all fifteen numbers have been drawn without matching the four assigned numbers, whichever occurs first (block 26). The player's assigned numbers for each card are compared to the numbers as drawn—i.e. when the fifth number is drawn and when the sixth, seventh, eighth, ninth, tenth, eleventh, twelfth, thirteenth, fourteenth and fifteenth numbers are drawn—and if four assigned numbers on a player's card match the numbers drawn at any such point (block 28) a prize is paid from the game pool (block 30), at which point the game is over for that card. For cards having four assigned numbers that do not match four of the fifteen numbers drawn when the fifteenth ball is drawn, the game is over (block 32).

Different levels of prizes from the game pool are paid for four matches during the drawing of the fifth through fifteenth numbers (blocks 26, 28 and 30). For example, for four matches out of the first five numbers drawn (whether or not including the wild designation), the prize paid (block 30) may be 500 times the original wager to the game pool; matching four out of the first six numbers drawn may pay 150 times the original game pool wager; matching four of the first seven or eight numbers drawn may pay 25 times the original game pool wager; matching four out of the first nine or ten numbers drawn may pay 10 times the original game pool wager; matching four out of the first eleven or twelve numbers drawn may pay 5 times the original game pool wager; and matching four out of the first thirteen to fifteen numbers drawn may pay 2 times the original game pool wager. Alternatively, the prizes from the fifth to the fifteenth numbers drawn may be pari-mutuel payoffs based upon decreasing percentages of the game pool. Unwon prizes and other unpaid amounts from each game pool may be added to the game pool for the next game.

According to the second preferred embodiment of the present game as illustrated in the flow chart of FIG. 2, the game is played by a plurality of players situated at respective player video terminals. A central random number generator, such as a conventional ball blower commonly used for bingo and keno games, is utilized for drawing the numbers and the wild designation, and as earlier discussed the random number generator and the plurality of terminals are networked with a central computer and server for implementing the game management and accounting functions. Similar to the game of bingo, each player plays against the other players for winning prizes from the game pool, as well as from the progressive pool.

Turning to FIG. 2, each player at the player terminals places a wager to the game pool (block 110) and, at the player's option, he or she may place a wager to the progressive pool (block 112). The wagers may be placed and received by the player terminals by utilization of devices and processes well known in the gaming art, including such devices for receiving and accounting for coins, cash bills, debit cards, credit cards and "smart" cards. Alternatively, the placing of the wager to the progressive pool may be mandatory rather than optional, and in any event a single cash, debit or credit entry may be made by the player with the terminal apportioning the amount entered to the game pool and to the progressive pool.

Each terminal is preferably capable of permitting the player to play a plurality of cards simultaneously, i.e. the player may play multiple cards each having four numbers assigned thereto as may be selected by the player or by the quick-pick feature, with each of the several (for example, up to four) cards being displayed on the terminal's video display.

Continuing with the game of FIG. 2, each player is assigned four numbers to each card for which a game pool wager has been placed (block 114). The ball blower, which contains twenty-five balls bearing numbers 1 through 25, and a twenty-sixth ball bearing a wild designation, randomly draws four balls (block 116). An example of a ball blower having an undesignated or unnumbered ball is described in U.S. Pat. No. 5,823,534 to Frank B. Banyai, the disclosure of which patent is incorporated herein by reference.

The four balls randomly drawn by the ball blower are compared with the four numbers assigned to each card of each player to determine whether the four numbers on any player card match the four numbers drawn by the random number generator (block 118). If four matches occur, a prize is paid to the player from the progressive pool (block 120), provided such player had placed a wager to the progressive pool, and may be referred to as the progressive jackpot. The four matches of the first four numbers drawn may be with or without the assistance of the wild designation which when drawn may be deemed by each player to represent any one of the four assigned numbers on each card not yet matched by the drawn numbered balls. In one manner of allotting prizes for four matches out of the first four balls drawn, the greatest jackpot may be paid to four assigned numbers matched, in numerical order, out of the first four numbered balls drawn; a second smaller jackpot may be paid to four matches, in any order, out of the first four numbered balls drawn; and a third yet smaller jackpot may be paid to four matches out of the first four balls drawn where three of the balls are numbered and one of the four balls is the wild designation. A fourth and smallest prize from the progressive pool (block 122) may be paid at this point, if one of the player's cards includes three numbers only (i.e. three but not all four assigned numbers) matching three of the four balls drawn whether or not including the wild designation (block 124).

In addition to the prizes paid from the progressive pool, the prizes awarded to any player having four matches out of the first four balls drawn (block 120) may include a prize from the player pool.

If the assigned four numbers on any card of any player match the first four balls drawn, the game is over (block 120). If, however, none of the players have matched four of his or her four numbers with the first four balls drawn, the game continues with the ball blower randomly drawing eleven additional balls, i.e. a total of fifteen balls (block 126). The players'assigned numbers for each card are compared to the balls as drawn—i.e. when the fifth number is drawn, and when the sixth, seventh, eighth, ninth, tenth, eleventh, twelfth, thirteenth, fourteenth and fifteenth numbers are drawn—and if four assigned numbers on a player's card match the numbers drawn at any such point (block 128) a prize is paid from the game pool (block 130), at which point the game is over for that card.

Different levels of prizes from the game pool are paid for four matches during the drawing of the fifth through fifteenth balls (blocks 126, 128 and 130). For example, for four matches out of the first five numbers drawn (whether or not including the wild designation), the prize paid (block 130) may be 500 times the original wager to the game pool; matching four out of the first six numbers drawn may pay 150 times the original game pool wager; matching four of the first seven or eight numbers drawn may pay 25 times the original game pool wager; matching four out of the first nine or ten numbers drawn may pay 10 times the original game pool wager; matching four out of the first eleven or twelve numbers drawn may pay 5 times the original game pool wager; and matching four out of the first thirteen to fifteen numbers drawn may pay 2 times the original game pool wager. Alternatively, the prizes from the fifth to the ninth balls drawn may be pari-mutuel payoffs based upon decreasing percentages of the game pool. Unwon prizes and other unpaid amounts from each game pool may be added to the game pool for the next game.

The game may end at this point, i.e. when the fifteenth ball has been drawn. Alternatively, the game may continue if no player's four assigned numbers are matched by any four of the fifteen balls drawn pursuant to blocks 116 and 126. In such case the ball blower continues to randomly draw balls (block 134) until a player's assigned four numbers are matched by the balls drawn pursuant to blocks 116, 126 and 134 (block 136), or until all twenty-six balls have been drawn, whichever occurs first. A prize is paid from the game pool (block 138) to the first player whose four assigned numbers are matched by the draws pursuant to blocks 116, 126 and 134, i.e. whose fourth matched assigned number occurs during the draw of block 134, whereupon the game is over as to all cards. A final prize of this type is often referred to as a "consolation" prize. The amount of the consolation prize may be posted on each video terminal prior to the beginning of each game and, instead of being paid from the game pool only of the game being played, may be paid from a consolation prize fund that may be seeded at a minimum amount (e.g. $25). If the consolation prize is not won in any game (e.g. if a player has four matches during the draws of blocks 116 and 126, ending the game without the draw of block 134), the amount of any such unpaid consolation prize may be added to the consolation prize fund so that the consolation prize will grow from the previously posted amount in progressive fashion game by game until the consolation prize is won.

Thus, there has been described preferred embodiments of a match number game suitable for casino play and particularly adapted for electronic implementation such as with video terminals. The game may be played by an individual player at a single terminal, or it may be played by multiple players at a plurality of terminals. Other embodiments of the present invention and variations of the embodiments presented herein may be developed without departing from the essential characteristics thereof. Accordingly, the invention should be limited only by the scope of the claims listed below.

I claim:

1. A method of playing a game by a player, comprising the steps of:

(a) the player placing a wager for each card of a plurality of cards to be played by the player;

(b) assigning to each of said cards a first plurality of designations from a set of designations;

(c) randomly drawing a first plurality of designations from said set;

(d) paying a prize to the player if the first plurality of designations assigned to any of said cards match the first plurality of designations drawn in step (c);

(e) if none of said cards' assigned first plurality of designations match the first plurality of designations drawn in step (c), continue randomly drawing designations from said set until a second plurality of designations of predetermined quantity greater than said first plurality by a plural quantity and fewer than all designations in said set are drawn from said set, the drawing of said second plurality of designations continuing regardless of whether or not any of said cards' assigned first plurality of designations match designations drawn; and (f) paying a prize to the player for each of said cards having an assigned first plurality of designations matching designations drawn in steps (c) and (e).

2. The method according to claim 1, further including:

in step (d), paying a prize to the player if any of said cards has a predetermined plurality of assigned designations less than said first plurality matching designations drawn in step (c).

3. The method according to claim 1, wherein:

in step (f), the prize paid decreases in value with each succeeding designation drawn in step (e).

4. The method according to claim 1, wherein:

in step (b), the player selects the designations assigned to him.

5. The method according to claim 1, wherein:

in step (a), the player places said wager to a game pool and at his or her option places an additional wager to a progressive pool.

6. The method according to claim 5, wherein:

the prize paid in step (d) is from the progressive pool provided the player had placed a wager to the progressive pool and from the game pool if the player had not placed a wager to the progressive pool; and the prize paid in step (f) is from the game pool.

7. The method according to claim 1, further including:

providing a wild designation for being randomly drawn as if a designation in said set, and if drawn in step (c) or (e) the player may deem one of his or her assigned designations on said cards to have been drawn.

8. The method according to claim 7, wherein:

the quantity of designations in said set is twenty-five, the quantity of designations of said first plurality is four, and the quantity of designations of said second plurality is fifteen.

9. The method according to claim 1, wherein:

in step (a), the player places said wager to a game pool and an additional wager to a progressive pool.

10. The method according to claim 9, wherein:

the prize in step (d) is from the progressive pool; and the prize paid in step (f) is from the game pool.

11. The method according to claim 10, further including:

in step (d), paying a prize from the progressive pool to the player if any of said cards has a predetermined plurality of assigned designations less than said first plurality matching designations drawn in step (c).

12. A method of playing a game by a plurality of players, comprising the steps of:

(a) each player placing a wager;

(b) assigning to each player a first plurality of designations from a set of designations;

(c) randomly drawing a first plurality of designations from said set of designations;

(d) paying a prize to each player whose assigned first plurality of designations match the first plurality of designations drawn in step (c);

(e) if no player's assigned first plurality of designations match the first plurality of designations drawn in step (c), continuing randomly drawing designations from said set of designations until a second plurality of designations of predetermined quantity greater than said first plurality by a plural quantity and fewer than all designations in said set are drawn, the drawing of said second plurality of designations continuing regardless of whether or not any of the players' assigned first plurality of designations match designations drawn; and (f) paying a prize to each player whose assigned first plurality of designations match designations drawn in steps (c) and (e).

13. The method according to claim 12, further including:

in step (d), paying a prize to a player having a predetermined plurality of assigned designations less than said first plurality matching designations drawn in step (c).

14. The method according to claim 12, wherein:

in step (f), the prizes paid decrease in value with each succeeding designation drawn in step (e).

15. The method according to claim 12, further including:

providing a wild designation for being randomly drawn as if a designation in said set, and if drawn in step (c) or (e) each player may deem one of his or her assigned designations to have been drawn.

16. The method according to claim 12, wherein:

each player may place additional wagers in step (a) and have assigned to him or her additional first pluralities of designations in step (b), for simultaneously subjecting each of his or her assigned first pluralities of designations to the play of steps (c) through (f).

17. The method according to claim 12, further including the steps of:

(g) if no player's assigned first plurality of designations match designations drawn in steps (c) and (e), continuing randomly drawing designations from the set of designations until a player's assigned first plurality of designations match designations drawn in steps (c), (e) and (g), or until all designations in said set have been drawn, whichever occurs first; and (h) if a player's first plurality of designations match designations drawn in steps (c), (e) and (g), paying a prize to such player.

18. The method according to claim 17, wherein:

if no player's assigned first plurality of numbers match the numbers drawn in steps (c) and (e), adding the amount of the prize unpaid in step (f) to a consolation prize fund.

19. The method according to claim 18, wherein:

the prize in step (h) is paid from the consolation prize fund.

20. The method according to claim 12, wherein:

in step (a), each player places a wager to a game pool and a wager to a progressive pool.

21. The method according to claim 20, wherein:

providing a wild designation for being randomly drawn as if a designation in said set, and if drawn in step (c) or (e) each player may deem one of his or her assigned designations to have been drawn.

22. The method according to claim 20, wherein:

each player may place additional wagers in step (a) and have assigned to him or her additional first pluralities of designations in step (b), for simultaneously subjecting each of his or her assigned first pluralities of designations to the play of steps (c) through (f).

23. The method according to claim 20, wherein:

the prize paid in step (d) is from the progressive pool; and the prize paid in step (f) is from the game pool.

24. The method according to claim 23, further including:

in step (d), paying a prize from the game pool to each player whose assigned first plurality of designations match designations drawn in step (c).

25. The method according to claim 23, further including:

in step (d), paying a prize from the progressive pool to each player having a predetermined plurality of assigned designations less than said first plurality matching designations drawn in step (c).

26. The method according to claim 23, wherein:

the prizes paid in step (f) decrease in value with each succeeding designation drawn in step (e).

27. The method according to claim 23, further including the steps of:

(g) if no player's assigned first plurality of designations match designations drawn in steps (c) and (e), continuing randomly drawing designations from the set of designations until a player's assigned first plurality of designations match designations drawn in steps (c), (e) and (g), or until all designations in said set have been drawn, whichever occurs first; and (h) if a player's first plurality of designations match designations drawn in steps (c), (e) and (g), paying a prize to such player.

28. The method according to claim 27, wherein:

if no player's assigned first plurality of designations match the designations drawn in steps (c) and (e), adding the amount of the prize unpaid in step (f) to a consolation prize fund.

29. The method according to claim 28, wherein:

the prize paid in step (h) is paid from the consolation prize fund.

30. A method of playing a game by a plurality of players, comprising the steps of:

(a) each player placing a wager to a game pool and at each player's option placing a wager to a progressive pool;

(b) assigning to each player a first plurality of designations from a set of designations;

(c) randomly drawing a first plurality of designations from said set of designations;

(d) paying a prize from the progressive pool to each player whose assigned first plurality of designations match the first plurality of designations drawn in step (c) provided he or she had placed a wager to the progressive pool;

(e) if no player's assigned first plurality of designations match the first plurality of designations in step (c), continuing randomly drawing designations from said set of designations until a second plurality of designations of predetermined quantity greater than said first plurality by a plural quantity and fewer than all designations in said set are drawn, the drawing of said second plurality of designations continuing regardless of whether or not any of the players' assigned first plurality of designations match designations drawn; and (f) paying a prize from the game pool to each player whose assigned first plurality of designations match designations drawn in steps (c) and (e).

31. The method according to claim 30, further including:

in step (d), paying a prize from the game pool to each player whose assigned first plurality of designations match the first plurality of designations drawn in step (c).

32. The method according to claim 30, further including:

in step (d), paying a prize from the progressive pool to each player having a predetermined plurality of assigned designations less than said first plurality matching designations drawn from in step (c).

33. The method according to claim 30, wherein:

the prizes paid in step (f) decrease in value with each succeeding designation drawn in step (e).

34. The method according to claim 30, further including:

providing a wild designation for being randomly drawn as if a designation in said set, and if drawn in step (c) or (e) each player may deem one of his or her assigned designations to have been drawn.

35. The method according to claim 30, wherein:

each player may place additional wagers in step (a) and have assigned to him or her additional first pluralities of designations in step (b), for simultaneously subjecting each of his assigned first pluralities of designations to the play of steps (c) through (f).

36. The method according to claim 30, further including the steps of:

(g) if no player's assigned first plurality of designations match designations drawn in steps (c) and (e), continuing randomly drawing designations from the set of designations until a player's assigned first plurality of designations match designations drawn in steps (c), (e) and (g), or until all the designations in the set have been drawn, whichever occurs first; and (h) if a player's first plurality of designations match designations drawn in steps (c), (e) and (g), paying a prize to such player.

37. The method according to claim 36, wherein:

if no player's assigned first plurality of designations match the designations drawn in steps (c) and (e), adding the amount of the prize unpaid in step (f) to a consolation prize fund.

38. The method according to claim 37, wherein:

the prize paid in step (h) is from the consolation prize fund.

* * * * *